United States Patent [19]

Ehle et al.

[11] 3,984,994

[45] Oct. 12, 1976

[54] PROCESS AND DEVICE FOR FILLING MULTILAYER PRESSURE CONTAINERS

[75] Inventors: Joachim Ehle, Essen; Karl-Friedrich Windgassen, Homberg, both of Germany

[73] Assignee: Messer Griesheim GmbH, Germany

[22] Filed: Dec. 5, 1972

[21] Appl. No.: 312,265

[30] Foreign Application Priority Data

Dec. 7, 1971 Germany .....2160640

[52] U.S. Cl. ..... 62/45; 220/9 LG

[51] Int. Cl.[2] ..... F17C 7/02

[58] Field of Search ..... 62/45; 220/9 LG, 10, 220/15

[56] References Cited

UNITED STATES PATENTS

| | | | |
|---|---|---|---|
| 3,304,729 | 2/1967 | Chandler et al. | 62/45 |
| 3,364,688 | 1/1968 | Matlow et al. | 62/45 |
| 3,374,638 | 3/1968 | Basile et al. | 62/45 |
| 3,512,581 | 5/1970 | Lawton | 62/45 X |
| 3,670,517 | 6/1972 | Nonnecke | 62/45 |
| 3,695,050 | 10/1972 | Bancroft | 62/45 |

*Primary Examiner*—William F. O'Dea
*Assistant Examiner*—Ronald C. Capossela
*Attorney, Agent, or Firm*—Connolly and Hutz

[57] ABSTRACT

Process for filling multilayer pressure containers with cold liquids below −10°C. comprises steps of cooling container from outside thereof inwardly to temperature that approximately corresponds to temperature of liquid to be filled. After such cooling the cold liquid is filled into the container. Multilayer pressure container has plurality of individual shells adjacent one another and cooling chamber surrounds shells.

2 Claims, 1 Drawing Figure

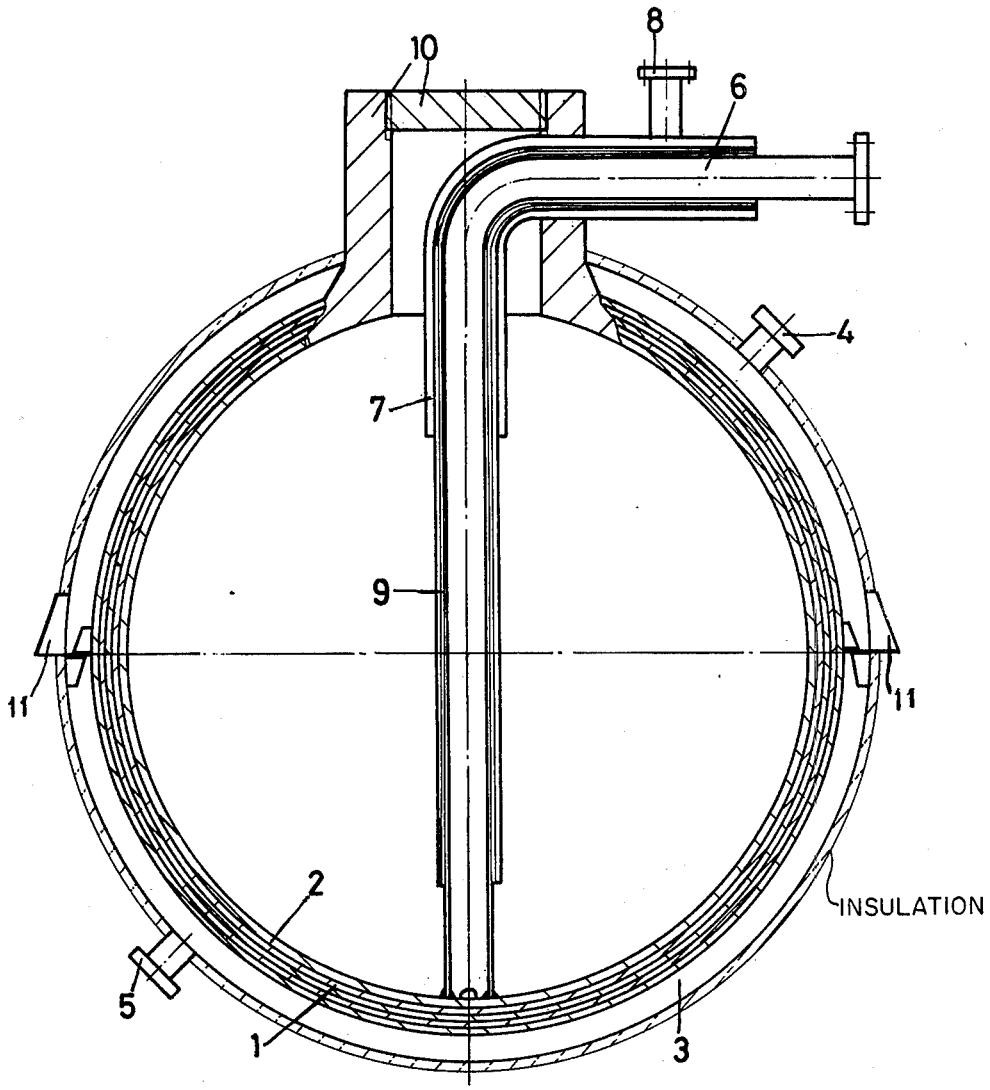
8
10
6
4
7
9
11
11
2
INSULATION
5
1
3

PROCESS AND DEVICE FOR FILLING MULTILAYER PRESSURE CONTAINERS

BACKGROUND OF THE INVENTION

The present invention relates to a process and a device for filling multilayer pressure containers with liquids below −10° C.

Pressure tanks that receive high internal pressures are customarily constructed as spheres or cylinders with plane or arched end pieces and with the manner of construction depending upon the process of manufacture. High pressure containers are cast seamless or forged or welded together from thick steel sheet which is bent and cut out as segments. For multilayer pressure containers, a plurality of relatively thin sheet shells are bent and welded together one over the other in several layers. Each shell must tightly abut the neighboring shells, since otherwise the entirety of the shells would not be uniformly subjected to the pressure load. As compared to other finishing techniques, the multilayer construction has several advantages. The innermost shell affected by the product may be constructed of a material different from that used for the pressure-bearing outer shells. Very strong close-grained structural steel is usually employed for the outer shells. The welding seams in the pressure-bearing layers may be staggered, the effect of the welding seams on the total stability remaining negligible. For the preparation of individual shells, heavy machines are not required as they are for thick sheets. Since thin sheets generally have better physical properties than thick sheets and since the quality control with thin sheets is also simpler than with thick sheets, multilayer pressure containers have very advantageous material properties.

Multilayer pressure containers, however, also have some disadvantages over single layer pressure containers. Particularly, the heat conductivity of a multilayer pressure container is lower than that of a massive wall container. This is also seen in the calculation prescription which limit the allowable computation temperature to −10° C. to +400° C. The upper limit of +400° C. may still be expanded with a suitable temperature control of the product to be filled in the container and a corresponding insulation of the multilayer pressure container, since in this instance, due to the higher temperature of the inside layer, it abuts the next layer with increased surface pressure which results a better heat conduction. It is possible to demonstrate by tests that the heat conduction becomes greater with an increasing surface pressure between the layers.

For products to be filled at temperatures below −10° C., multilayer pressure containers have not been suitable since the inner shell is subjected to a low product temperature and contracts relative to the overlying shell. This leads to a lessening of the surface pressure between the layers. The bearing strength of the outer layers is then no longer guaranteed. Also, with high inner pressure settings, plastic deformation or even failure of the inner shell may occur.

SUMMARY OF THE INVENTION

Accordingly, it is an object of the invention to make it possible to use multilayer pressure containers at temperatures below −10° C.

According to the present invention, a process for filling multilayer pressure containers with liquids below −10° C. has been found wherein, prior to filling, the multilayer pressure container is cooled froom the outside inwardly to a coolant to a temperature which corresponds approximately to the temperature of the liquid to be filled. A multilayer pressure container suitable for the execution of the novel process consists of a cooling chamber arranged about the pressure-bearing layers. The chamber is provided with intake and outlet openings for the coolant.

The filled container may, if necessary, be further cooled by the coolant. This above all is necessary when liquids inside the container are considerably colder than −10° C. It is advantageous to insulate the outside jacket of the cooling chamber from the surrounding temperature. The supply of heat to be interior of the novel, multilayer pressure container may be reduced when a concentric double or multiple pipe is employed as the intake and outlet conduit for the liquid to be filled into the container.

The advantage of the use of a concentric double or multiple pipe is that the inside conduits may be calculated and constructed as nearly pressureless, and consequently, aside from savings in material, a greater flexibility and a lesser heat supply to the cold product chamber are also achieved. The inner conduit may be utilized for conducting the cold product to be filled while the outside conduit may be used as an exhaust gas conduit with low-temperature liquid gases. Additional cooling of the pressure-resistant outside pipe and consequently a reduction of the heat supply to the cold product are thereby achieved. For a better insulation of the exhaust gas conduit as compared to the product supply conduit, the inside pipe may also be constructed with double walls, resulting in an insulation slot, so that together with the outside pipe, there results a threefold pipe.

The advantage of the novel process is that the possibilities of application of multilayer pressure containers are broadened into the range of very low temperatures, say 4° K, and multilayer pressure containers may consequently be employed in a temperature range which previously was reserved for solid wall containers. The disadvantage of the poorer heat conductivity of the multilayer pressure containers as compared to solid wall containers is eliminated by controlled cooling from the outside. The temperature of the outer layer is lowered first, whereby as a result of the contracting effect, an increased surface pressure occurs between the layers and consequently an improved heat conduction between the layers which leads to quick cooling of the layer situated underneath. This procedure is repeated in the following layers. By means of the controlled temperature in the cooling chamber, the individual layers are cooled uniformly. Lifting of the layers from each other does not occur, and uniform bearing of the individual layers is assured.

BRIEF DESCRIPTION OF THE DRAWING

Novel features and advantages of the present invention in addition to those mentioned above will become apparent to those skilled in the art from a reading of the following detailed description in conjunction with the accompanying drawing which shows a sectional view of a container, according to the present invention.

DETAILED DESCRIPTION OF THE INVENTION

The pressure container consists of several layers of thin shells 1 which are curved and made of highly stable sheet steel welded together. The inner layer or shell 2 consists of an alloyed steel which is chemically resistant to the material to be filled into the container. According to the invention, a cooling chamber 3 is arranged around the pressure layers 1. The cooling chamber is provided with inlet openings 4 and outlet openings 5 for the coolant. Additionally, the jacket of the cooling chamber may be insulated, if desired. The inlet and outlet conduit 6 for the product to be filled into the container consists of a concentric threefold pipe. Cold evaporation gas escapes through the outer annular slot 7 and the exhaust gas pipe 8 to thereby cool the inner pipe 9. The product-conducting inner pipe 9 has a double-wall construction which provides an insulating slot. Since the inner pipe 9 is practically under the same pressure from inside and from outside, it may be constructed with very thin walls whereby the heat supply to the interior of the container is reduced. The opening 10 of the assembly enables access to the interior of the multilayer pressure container. The multilayer pressure container is supported with mounting supports 11 on a frame (not shown).

What is claimed is:

1. A multilayer pressure container comprising a plurality of individual metal shells adjacent one another. each shell in intimate contact throughout its surface with the adjacent shells surrounding it, a cooling chamber surrounding the individual shells having intake and outlet openings therein for circulating coolant through the cooling chamber for cooling the metal shells from the outside to the interior thereof prior to filling the container with cold liquid, insulation on the outside of the cooling chamber, and inlet and outlet means communicating with the interior of the container.

2. A multilayer pressure container as in claim 1 wherein the inlet and outlet means comprises a concentric multiple conduit having a passageway therethrough for introducing and removing cold liquid from the container, and another passageway in the conduit for the escape of cold evaporating gas.

* * * * *